United States Patent [19]

Kasahara et al.

[11] 4,238,250

[45] Dec. 9, 1980

[54] PROCESS FOR DYEING ZINC AND ZINC ALLOYS

[75] Inventors: Nobuyoshi Kasahara, Sayama; Koutarou Nonomura, Kunitachi, both of Japan

[73] Assignee: Mitsui Mining & Smelting Co., Ltd., Tokyo, Japan

[21] Appl. No.: 18,324

[22] Filed: Mar. 7, 1979

[30] Foreign Application Priority Data

May 4, 1978 [JP] Japan ..... 53/52807

[51] Int. Cl.[3] ..... C23F 7/26; C23F 5/04

[52] U.S. Cl. ..... 148/6.1; 148/6.2

[58] Field of Search ..... 148/6.1, 6.2; 427/277; 204/18 R, 35 N

[56] References Cited

U.S. PATENT DOCUMENTS

| | | | |
|---|---|---|---|
| 2,393,640 | 1/1946 | King | 148/6.1 |
| 2,477,310 | 7/1949 | McLean | 148/6.1 |
| 2,594,820 | 4/1952 | Stern | 204/18 R |
| 2,604,418 | 7/1952 | Stern | 148/6.1 |
| 2,691,627 | 10/1954 | Johnson | 204/18 R |
| 3,147,153 | 9/1964 | Harris et al. | 148/6.1 |

*Primary Examiner*—Ralph S. Kendall

*Attorney, Agent, or Firm*—Armstrong, Nikaido, Marmelstein & Kubovcik

[57] ABSTRACT

A multi-colored decorative zinc or zinc alloy having locally organic dyestuff-dyed portions in multi-color is prepared by (1) dyeing with a dyestuff zinc or zinc alloy having a dyeable chromate film bonded thereonto, (2) polishing locally the dyed surface of zinc or zinc alloy, (3) making the chromate film on the exposed surface, (4) dyeing with another dyestuff having a different color the chromate film on the exposed surface, and then the steps (2), (3) and (4) may successively be repeated.

6 Claims, No Drawings

PROCESS FOR DYEING ZINC AND ZINC ALLOYS

This invention relates to a process for producing zinc or a zinc alloy (hereinafter sometimes referred to as zinc) having more than one decorative color on the surface basically by the use of chemical dyeing techniques.

There have heretofore been known a method for decorative coloring comprising forming a metallic coating, such as copper electroplate, on zinc or a zinc alloy and then coloring a part of the metallic coating black or in other colors with a chemical agent such as a sulfur compound thereby providing the zinc or zinc alloy with a so-called "dull or mat" decorative appearance and a method for coloring in more than one color comprising using conventional painting techniques in combination with masking techniques. However, the former method cannot give multi-color decorative appearance to zinc or a zinc alloy since the kinds of electrolyzable metals are limited and the colors of these metals are also limited to a metallic color such as silvery and coppery colors, while the latter can color zinc or a zinc alloy in various different colors but it does not produce a colored zinc giving a transparent appearance and metallic gloss since the dye used is, in almost all cases, an opaque pigment nor does it produce a colored zinc giving a dull or mat appearance shade since the boundary between the different colors is unnecessarily clearly defined in masking. In addition, the latter method is defective in stability in that no satisfactory adhesion is very often effected between a paint and zinc on which the coating is formed.

On the other hand, the present inventors have put in use a method for chemically dyeing zinc as disclosed in U.S. Pat. No. 3,405,014. By combining this chemically dyeing method as the basic one with certain other treatments for dyeing, local polishing treatment and the like, they have thoroughly eliminated the disadvantages of the aforesaid known coloring method and have thus developed a novel dyeing process for producing dyed products having remakably decorative appearance and a wide combination of colors on the surface. The novel process makes it possible to effect an excellent decorative dyeing on zinc-made products such as zinc plates and zinc die casts and also to form an excellently corrosion-resistant coating on the zinc-made products.

Thus an object of the present invention is to provide a chemically dyed multi-colored decorative zinc giving a stable transparent appearance and metallic gloss.

Another object of the present invention is to provide a process for chemically dying zinc into a multi-colored decorative appearance.

According to the present invention there are provided a multi-colored decorative zinc or zinc alloy having locally organic dyestuff-dyed portions in multicolor including silvery color of the zinc surface itself, the dye-stuff being chemically bonded through chromate-film on the surface of zinc or zinc alloy.

As an aspect of the invention there is provided a process for chemically dyeing zinc or zinc alloy in multi-color, which comprises the steps of (1) dyeing with a dyestuff zinc or zinc alloy having a dyeable chromate film bonded thereto, (2) polishing locally the dyed surface to expose the surface of zinc or zinc alloy, (3) making the chromate film on the exposed surface, (4) dyeing with another dyestuff having a different color the chromate film on the exposed surface, and then the steps (2), (3) and (4) may successively be repeated.

As another aspect of the invention there is provided a process for chemically coloring zinc or zinc alloy in multi-color including the silvery color of zinc or zinc alloy itself, which comprises the steps of the above (1) and (2), the step of (5) coating the exposed surface with a corrosion-resistant, non-colored clear chromating, and then the steps of the above (2), (3) and (5) may successively be repeated.

As further aspect of the invention there is provided a process for chemically dyeing zinc or zinc alloy in multi-color including the silvery color of zinc or zinc alloy itself, which comprises the steps of (6) subjecting the surface of zinc or zinc alloy to corrosion-resistant, non-colored clear chromating, the steps of the above (2), (3) and (4) being successively be carried out.

The material to be given a decorative multi-color is zinc or zinc alloy containing as a major proportion zinc, in any form which has preferably uneven surface. The method for producing a chromate-derived film on the surface may be any one which has been known. However, when a colored but dye-receptive chromate film is desired the most preferable method is disclosed in U.S. Pat. No. 3,405,014 in which a dyed chromate film on zinc and zinc alloys is produced by treating a zinc or a zinc alloy article with a solution, the dissolved constituents of which consist of chromic acid, an inorganic chloride salt and an inorganic sulfate salt; said chromic acid comprising the sole source of hydrogen ions in the solution; washing the article after the treating step; and then dyeing the article.

The dyed film thus obtained is deep in color, and high in gloss, adhesion and corrosion resistance. The chromate film and the dyed film are excellent in close adhesion to an organic coating thereon, if such coating is effected. When a colorless and transparent chromate-derived film is desired on the surface of zinc to make silvery color remain, the method of Japanese Patent Publication No. 22336/77 or Japanese Patent Publication No. 38972/77 may be utilized, although the film is not dyable. The former publication discloses such a process for producing a colorless corrosion-resistant chromate film compromising immersing zinc or zinc alloy in a strongly alkaline solution containing 5 g/l or more of hexavalent chromium compound but not containing a complex-making agent of said chromium compound. And the latter publication discloses a process for producing a zinc alloy article having a transparent chromate film characterized by immersing the material of an alloy of zinc which contains aluminum in a strongly alkaline solution of pH 12 or more for 10 seconds to 10 minutes, immersing in a solution containing chromic acid, water-soluble fluoride, and at least one phosphoric acid component of phosphoric acid or water-soluble phosphate to form chromate-film. The pretreatment with strongly alkaline solution is also disclosed in Japanese Patent Kokai (Laid-open) No. 115750/77. The treatment with alkali solution may be effected on the chromate-film forming treatment followed by additional chromate-film forming treatment. (Japanese Patent Publication No. 28730/77.

Besides a chromate-treating method which comprises effecting a well known dyeable chromate treatment for zinc and then decoloring by dipping in a dilute alkali solution (a well known method as, so-called, "unichrome process") may, of course, be used.

After a colored or colorless chromate film is formed on the surface of zinc or zinc alloy, the whole surface is dyed in an optional color with a dyestuff such as Alizarin dyes shown, for example, in the aforesaid U.S. Pat. No. 3,405,014 [hereinafter referred to as dyeing step (I)]. In the present invention, the dyeing step (I) which is carried out by immersing the treated zinc in the dye solution at about room temperature is based on the techniques involving the formation of dyeable chromate-treated films, and therefore the dyed film strongly resists the peeling-off and corrosion and is tolerable to heat, dissolution and the like which the film encounters in the repeatedly treating steps of local polishing, chromate treatment, and dyeing, giving a uniform and good surface dyed without uneven dyeing. It is considered that such even good dyed surface as mentioned above can be obtained especially in case of using the chromate treatment solution shown in U.S. Pat. No. 3,405,014, because the composition forming said chromate film have very good chemical affinity and chemical bonding ability to dyestuffs.

The dyed film is, if needed, subjected to clear lacquer-coating as an aspect of the invention for preventing the aforesaid dyed film from deterioration of color tone which is caused by the alkali treatment for the purpose of removing aluminum from zinc alloy containing aluminum as mentioned below. However, it may be omitted in accordance with kinds of the dyestuff and the chromate method. In case that it is omitted, it is desirable to make the dyed film stand still in a dry atmosphere to remove water and solidify the dyed film. However, desirable effects can be easily attained in general when the dyed film is subjected to coating with a clear lacquer mentioned above even by less than 5$\mu$ in thickness, because the dyed surface is protected in successive steps. Baking of the clear lacquer is included, as a matter of couse, depending on the kind of clear lacquers.

Next, the surface of the dyed zinc is locally polished by a suitable method to make the zinc surface of the polished part exposed for the purpose of attaining the desired decorative effects. As polishing methods in this case, conventional ones such as general polishing by a buff, polishing by a satin buff, or polishing by a barrel, polishing by a vibrating barrel, and the like can be utilized. The resulting polished zinc is degreased; if desired, and then subjected to the second dyeing process (hereinafter referred to as dyeing step II). In case of using zinc alloy containing aluminum, that is zinc dye cast product which usually contains 4% aluminum and super-plastic zinc alloy usually containing 22% aluminum, it is more suitable to take a step of removing aluminum for obtaining brighter color in the dyeing step (II). Thus the exposed surface is immersed in a strong alkaline solution having the concentration of 1–30% (pH 12 or more) of, for example, a caustic soda to carry out removal of aluminum from the surface, according to the method, for example, of Japanese Patent Publication No. 43174/74 or the like before it is subjected to the dyeing step (III).

In the dyeing step (II), chromate-treating and dyeing of the zinc surface exposed by the polishing are carried out once more almost in the same manner as in the dyeing step (I). Brighter colors than in the dyeing step (I), for example orange, yellow and the like are desired in general for attaining highly decorative feeling and antique feeling. Furthermore, since the degree of evenness of the polished surface affects the gloss of color tone of the dyed surface prepared by the dyeing step (II), it is desired to pay attention thereto.

The dyed zinc in two colors, which is produced by the aforesaid steps may be made as a product as it is, but in many cases it is preferably subjected to coating with a clear lacquer to make a transparent protective film, whereby abrasion resistance and corrosion resistance are increased without spoiling decorative appearance and durability for a longer period.

In addition, it is an aspect of the invention, if the silvery appearance is desired in the decorative colored portions, that the exposed zinc surface is subjected to treatment for making a colorless, corrosion resistant chromate film according to aforesaid Japanese Patent Publication No. 22336/77 or No. 38972/77, instead of the dying step (II). In this cases, silvery color on the basis of metallic gloss of zinc comes to be locally attained on the surface dyed by the dyeing step (I), and "dull or mat" decorative appearance is obtained.

Furthermore, as another embodiment of working the present invention, each of locally polishing step, chromate treating step, and dyeing step is repeatedly carried out, if desired, several times after the dyeing step (II), thereby to obtain multi-color decorative coatings.

The feature of the present invention resides in polishing locally the dyed surface after dyeing whole surface by the dyeing step (I) to expose a part of the zinc surface and dyeing the exposed part of the surface in mother color by the dyeing step (II) without masking, and in addition, in case of zinc alloy, subjecting to a previous treatment of removing aluminum, if necessary, before effecting the dyeing step (II), thereby to make the color of the surface dyed by the dyeing step (II) brighter and further to attain higher decorative effects.

An effect attained by the method of the present invention resides in that kinds of colors and their combination can be selected in a wide range, as compared with conventional coloring processes by electro-plating. That is, it is possible to combine almost all colors by selecting organic dyestuffs to be used. Furthermore, metalic gloss which is hardly obtained by a conventional coating can be obtained, by selecting the polishing method. Besides, the masking process is not required. Another effect resides in that the product treated by the method of the present invention has better corrosion resistance. According to the method of the present invention, the ground of the dyeable surface is a chromate film and therefore it has much better corrosion resistance than a phosphate film. The former film has corrosion resistance of such a degree as being durable for 50–100 hours by a salt spray test of JIS Z 2371 which corresponds to ASTM B117 even in the condition of the dyed film. Furthermore, the corrosion resistance increases by subjecting the dyed surface to coating with a clear lacquer as mentioned in the explanation of the aforesaid step. Even by the salt spray test of JIS Z 2371, resistance against rust for more than 300–500 hours can be easily attained in general cases. On the other hand, in case of conventional electro-platings, especially in case of copper electroplating it is carried out by electrolizing copper over the zinc surface and therefore there is a danger of generating easily corrosion on the zinc ground by a pin hole and a formation Cu-Zn local cell. In many cases generation of corrosion is observed 50–100 hours later by the aforesaid salt spray test. In case of painting too, good corrosion resistance is hardly attained in general, and in many cases adhesion of the coated film onto the zinc surface is poor.

The present invention has characteristics which can not be attained by any conventional methods, as mentioned above, and therefore it may be said to be the best method as quite an excellent process for treating various kinds of zinc products such as of zinc die casts, zinc plate and the like on which such a coating as particularly antique decorative feeling as well as durability for zinc a long period of time is required. It may be widely employed for products in various fields, such as metal fittings of buildings, daily necessaries made of metals and the like.

Furthermore, since the present invention is based on a dyeing process utilizing chemical properties of zinc, as an application of the method of the present invention it is possible as a matter of course to dye by the dyeing step (II) of the present invention the zinc surface locally exposed by polishing the dyeable surface after effecting previously coating or other chemical coloring processes than dyeing, for example black chromate treating process, instead of the dyeing step (I). However, corrosion resistance is sometimes poor in this case.

The present invention will be explained in detail by the following Examples.

EXAMPLE 1

After immersing the uneven surface of a zinc alloy die casting containing 3.5–4.3% aluminum (JIS H5301, ZDC 2) in an aqueous solution containing 100 g/l of chromic acid, 10 g/l of $NH_4Cl$ and 30 g/l of $ZnSO_4$ at 35° C. for 10 seconds, the surface was washed and immersed in an aqueous solution containing 5 g/l of acid Anthracene Brown RH at 50° C. to dye the surface in brown. After drying the surface, the surface was coated with a clear lacquer of melamine origin by about 2μ thickness, baked and hardened at a definite temperature, and polished slightly the surface by a buff, whereby the convex surface parts of the zinc alloy were exposed. Next, the exposed parts were immersed in an aqueous solution containing 20 g/l of NaOH and 5 g/l of NaF at 40° C. for 3 minutes, washed with water, repeatedly immersed in the aforesaid chromate treating solution for about 10 seconds, and then dipped in an aqueous dye solution containing 2 g/l of Alizarin Yellow GG at 50° C. for 3 minutes. The resulting surface was washed with water and dried to yield a colored product rich in decorative feeling, of which concave parts become brown and convex parts were dyed in pale yellow having metallic gloss.

The product was further coated with a malamine clear lacquer of the same origin to be about 15μ thick, baked and hardened. Abrasion resistance of the surface was remarkably increased and the surface showed such excellent characteristics as indicated in the following table the properties of normal copper electro-plated zinc die cast being shown therein as comparison.

| Samples | Salt spray test by JIS Z 2371 | Remarks |
|---|---|---|
| Product treated by the method of the present invention | No generation of rust till 480 hours later | |
| Copper electro-plate (zinc die cast ground) | 48 hours later | Both samples have antique decorative appearances which considerably resemble each other, but they are remarkably different in the point of corosion resistance. |

EXAMPLE 2

A zinc plate (4 mm thick) etched to make the surface uneven was chemically dyed in same way as in Example 1. The washed material was dried completely in a room over a night to harden the dyed chromate film. Then, the surface was polished in form of satin by an enery buff (#180 ) to expose the convex parts of the zinc surface, and repeatedly subjected to dyeing treatment with a treating liquor having the same composition by the same method as in Example 1. As the result, the concave parts were dyed in pale brown and convex parts in semi-glossy yellow. The product dyed in two colors was obtained.

In case of the present Example, coating with a clear lacquer after the dyeing step (I) was omitted and therefore the brown color of the surface treated by the dyeing step (I) becomes a little paler than that in case of Example 1 by influence of the successive steps. However, sufficient decorative feeling for its practical use could be attained.

EXAMPLE 3

Super-plastic zinc alloy molded in the form of a wall-plate having an uneven surface (Zn 78% and Al 22%) was degreased, immersed in an aqueous solution containing 100 g/l of KOH and 50 g/l of $Na_2Cr_2O_7$ at 70° C. for 3 minutes, washed with water, and then immersed in a chromate treating liquor which contains 100 g/l of chromic anhydride, 10 g/l of $NH_4Cl$ and 70 g/l of $ZnSO_4$ at 35° C. for 10 seconds, washed with water, and immersed in an aqueous solution containing 10 g/l of Anthracene Blue SWGG for 5 minutes to dye whole surface in blue. After drying, the surface was coated with an polyacrylic clear lacquer capable of being dried at normal temperature in a thickness of about 3μ, stood still, dried and hardened. Then, the convex parts were polished by means of a satin buff to expose locally the zinc alloy surface, and again subjected to the chromate treating with an aqueous solution containing chromic acid anhydride (20 g/l) and caustic potassium (100 g/l ) at 50° C. for one minute and then with an aqueous solution containing chromic acid an anhydride (20 g/l) and 10% sulfuric acid (1 ml/l) at 30° C. for 10 seconds. After washing the exposed parts with water, the whole surface was subjected to protecting coating with an acryl clear lacquer driable at room temperature. Thus prepared surface had a good decorative effect, of which concave parts were dark blue and convex parts were semi-glossy and semi-transparent.

The resulting film had same excellent corrosion resistance as shown in Example 1 and good adhesive property.

Such two colors of red and blue systems can not be obtained by conventional metal platings. Also in a conventional painting process, a complex masking step is required therefor, and it is quite difficult to make a semi-transparent, semi-glassy coating having good properties. For these reasons it is impossible to obtain such good appearance by conventional processes.

EXAMPLE 4

Zinc alloy die casting same as used in Example 1 was subjected to the treatment disclosed in Example 1 of the specification of Japanese Patent Publication No. 28730/77.

That is, the alloy was immersed in a chromate-forming aqueous solution containing chromic acid (100 g/l), $NH_4Cl$ (10 g/l) and zinc sulfate (30 g/l) at 35° C. for 10 seconds to form a chromate film. After washing, it was immersed in 5% sodium carbonate solution at 30° C. for 10 seconds and washed. Then it was once more immersed in the same aqueous chromate-forming solution for 10 seconds. After washed the alloy was dyed with a dyeing solution containing 5 g/l of chrome Black AC at 50° C. for 5 minutes to dye the surface to black and washed with water.

After dried, the alloy is coated with melamine-coating agent in a thickness of 2μ, polished locally to expose the chromate film.

After drying the alloy is degreased with trichloroethylene and washed with water, and again subjected to a chromate-forming treatment according to Japanese Patent Publication No. 22336/77. That is, the alloy was immersed in an alkaline aqueous solution containing chromic acid (20 g/l) and caustic potassium (100 g/l) at 50° C. for 1 minute and washed with water. Then the alloy was immersed in an acidic solution containing chromic acid anhydride (20 g/l ), sulfuric acid (1 ml) at 30° C. for 10 seconds, washed with water and allowed to stand to dryness.

To the chromate film was applied a clear melamine coating material, and baked at 140° C. for 20 minutes.

The surface of the alloy was dyed in black in concave parts and had a transparent silvery gloss in convex parts. And it has a very decorative appearance.

EXAMPLE 5

Example 1 was repeated to obtain a zinc alloy die casting having dyed, and local exposed surface. Then the alloy was subjected to the same treatment of Example 1 of the specification of Japanese Patent Publication No. 22336/77 as in Example 4.

The product obtained was dyed in brown in concave parts and had a silvery color in convex parts, giving a very decorative appearance.

What is claimed is:

1. A process for chemically coloring zinc or zinc alloy in multi-color, which comprises the steps of (1) dyeing with a dyestuff zinc or zinc alloy having a dyeable chromate film bonded thereonto, (2) polishing locally the dyed surface to expose the surface of zinc or zinc alloy, (3) making the chromate film on the exposed surface, (4) dyeing with another dyestuff having a different color the chromate film on the exposed surface, and then the steps (2), (3) and (4) may successively be repeated.

2. A process for chemically coloring zinc or zinc alloy in multi-color including the silvery color of zinc or zinc alloy itself, which comprises the steps of (1) dyeing with a dyestuff zinc or zinc alloy having a dyeable chromate film bonded thereonto, (2) polishing locally the dyed surface to expose the surface of zinc or zinc alloy, and then the step of (3) subjecting the exposed surface to a corrosion-resistant, non-colored clear chromating, and then the steps of (2) and (3) may successively be repeated.

3. A process for chemically coloring zinc or zinc alloy in multi-color including the silvery color of zinc or zinc alloy itself, which comprises the steps of (1) dyeing with a dyestuff zinc or zinc alloy having a dyeable chromate film bonded thereonto, (2) polishing locally the dyed surface to expose the surface of zinc or alloy, and then the step of (3) coating the exposed surface with a non-colored clear coating material, (4) polishing locally the dyed surface or the coated surface to expose the surface of zinc or zinc alloy (5) making the chromate film on the exposed surface, (6) dyeing with another dyestuff having a different color the chromate film on the exposed surface, and then the steps (2), (3), (4) and (6) may successively be repeated.

4. A process for chemically dyeing zinc or zinc alloy in multi-color including the silvery color of zinc or zinc alloy itself, which comprises the steps of (1) subjecting the surface of zinc or zinc alloy to corrosion-resistant, non-colored clear chromating, (2) polishing locally the surface having chromate film to expose the surface of zinc or zinc alloy, (3) making a dyable chromate film on the exposed surface, (4) dyeing with a dyestuff the chromate film on the exposed surface, the steps (2), (3) and (4) being successively be repeated, provided that the dyeing in step (4) is effected with another dye having a different color.

5. A process for chemically dyeing zinc or a zinc alloy in multi-color including the silvery color of zinc or the zinc alloy, which comprises the steps of (1) subjecting the surface of the zinc or the zinc alloy to corrosion-resistant non-colored clear chromating to form a corrosion-resistance, non-colored clear chromate film thereon, (2) polishing a predetermined portion of the surface having the corrosion-resistant, non-colored clear chromate film thereon to expose the surface of zinc or the zinc alloy, (3) forming a dyeable chromate film on the exposed surface by immersing the zinc or zinc alloy from step (a) in a first solution consisting essentially of chromic acid, water and water soluble inorganic salts, and (4) dyeing with a dyestuff the chromate film on the exposed surface by immersing the zinc or zinc alloy from step (3) in a second aqueous solution consisting essentially of water and a dye, the steps (2), (3) and (4) being successively repeated, provided that the dyeing in repeated step (4) is effected with another dye having a different color.

6. The process according to claim 1, 2, 3, 4 or 5 wherein zinc alloy containing aluminum has been immersed into a strongly alkaline solution of pH 12 or more to remove aluminum from the surface layer of the alloy.

* * * * *